United States Patent [19]

Tokuno

[11] 4,169,752

[45] Oct. 2, 1979

[54] PROCESS AND APPARATUS FOR SPLICING WEB

[75] Inventor: Masateru Tokuno, Nishinomiya, Japan

[73] Assignees: Rengo Kabushiki Kaisha (Rengo Co., Ltd.), Osaka, Japan; Simon Container Machinery Limited, Stockport, England

[21] Appl. No.: 852,044

[22] Filed: Nov. 16, 1977

[30] Foreign Application Priority Data

Dec. 16, 1976 [JP] Japan ..... 51/151550
May 13, 1977 [JP] Japan ..... 52/56692

[51] Int. Cl.[2] ..... B65H 19/08

[52] U.S. Cl. ..... 156/157; 156/159; 156/504; 156/505; 242/58.4; 242/58.5

[58] Field of Search ..... 156/159, 157, 304, 504, 156/502, 505; 242/58.3, 58.4, 58.5, 58.1, 56 R, 59

[56] References Cited

U.S. PATENT DOCUMENTS

| | | | |
|---|---|---|---|
| 3,276,710 | 10/1966 | Zernov et al. | 242/59 |
| 3,520,748 | 7/1970 | Riegger | 156/504 |
| 3,622,097 | 11/1971 | Maas | 242/58.4 |
| 3,891,158 | 6/1975 | Shearon et al. | 156/504 |

*Primary Examiner*—Jerome W. Massie
*Attorney, Agent, or Firm*—Wenderoth, Lind & Ponack

[57] ABSTRACT

A process and an apparatus for splicing a web of paper being continuously supplied without decelerating the machine speed and with a minimum of material loss.

A new paper web is spliced to the old paper web with adhesive tape and the old paper is cut off just behind the spliced point by means of a plate member which cooperates with a fixed blade provided along the run of the spliced paper.

8 Claims, 14 Drawing Figures

PROCESS AND APPARATUS FOR SPLICING WEB

The present invention relates to a process and an apparatus for splicing paper being continuously supplied with a minimum of material loss and without reducing the machine speed.

In the production of corrugated paper board, just before the liner paper being supplied from one paper roll runs out, the new liner paper from another roll has to be spliced thereto for continuous operation. With the conventional splicing machine, if splicing is done while running the machine, the new paper will overlap the old paper at the splice for a considerable distance, causing a large loss of material. Conversely, splicing with the machine stopped or slowed will eliminate such an overlap, but decrease the production of the machine. Also, difficulties such as discoloration or warping of the corrugated paperboard will result because the liner paper lies on a heating plate for too long a time.

An object of this invention is to provide a process and an apparatus for splicing paper without stopping the machine and with a minimum of material loss.

Other features and advantages of the present invention will become apparent from the following description with reference to the accompanying drawings; in which FIG. 1 is a side elevation view of the splicing apparatus according to this invention;

Figure 1:
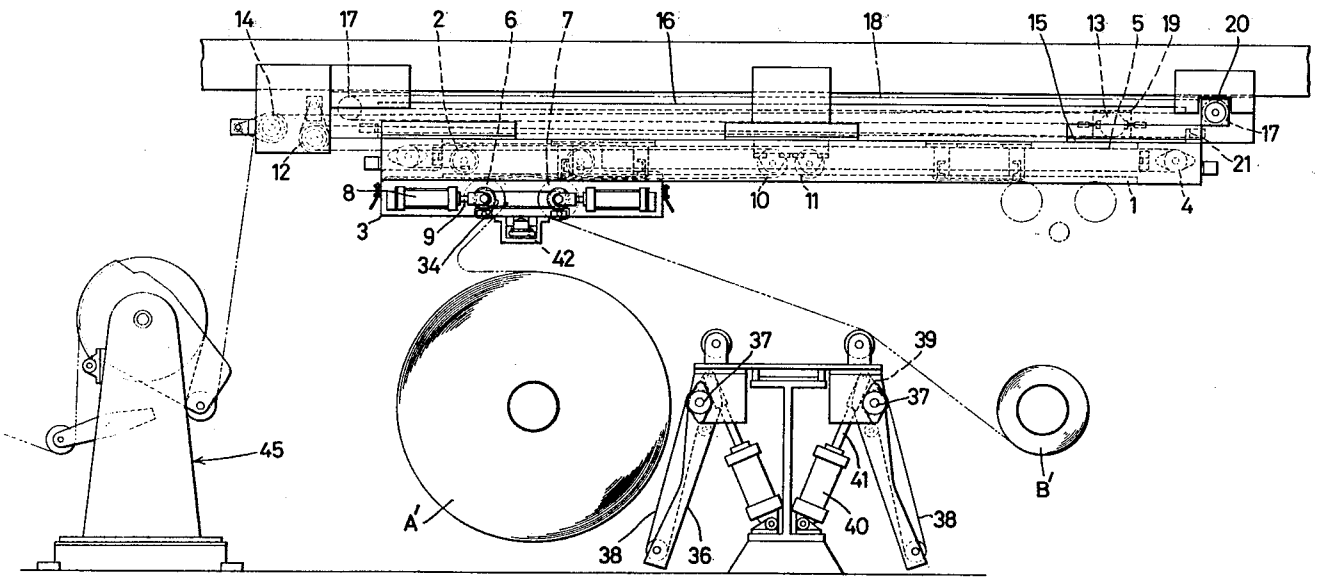
Figure 2:
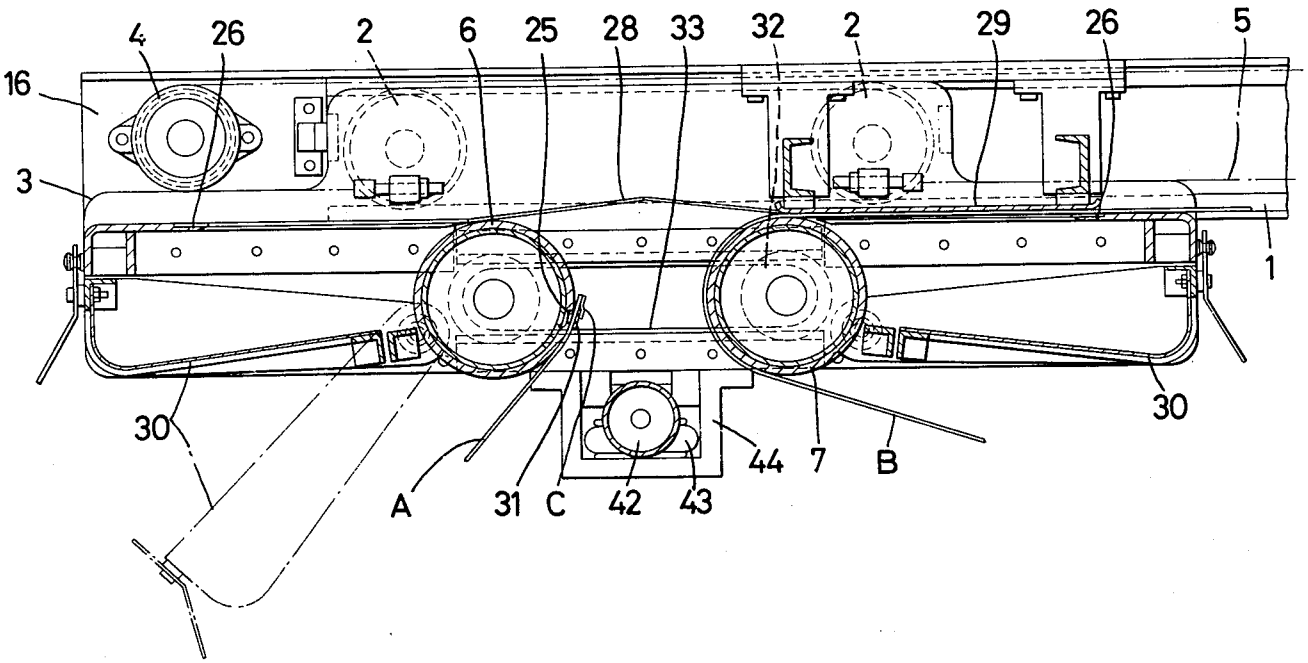
FIG. 2 is a partially sectional elevation view, on an enlarged scale, of a portion of the apparatus shown in FIG. 1.

Referring to the drawings, a horizontal guide rail 1 is provided on each side of the splicing machine according to this application. A carriage 3 is provided which is movable on each guide rail 1 on two wheels 2 thereon. The carriage 3 is secured to an endless chain 5 passing around a sprocket 4 provided at each end of the guide rail 1. One of the sprockets 4 is driven by a motor (not shown) to move the carriage 3 to a desired position.

An opposed pair of splicing rollers 6 and 7 are mounted on the carriage 3 with their axes and so as to be movable toward and away from each other. Each splicing roller is coupled to a piston rod 9 protruding from a cylinder 8 supported on the carriage.

First and second horizontal guide rollers 10 and 11 are laterally mounted in the center of the guide rail 1. A third guide roller 12 is provided outside of one end (the paper feed end) of the guide rail 1 with its axis horizontal, and a fourth guide roller 14 is provided slightly outside of and slightly above the third guide roller 12.

An accumulator roller 13 is mounted so as to be movable between the ends of the guide rail 1. It is journaled at each end thereof in a slider 19 slidably mounted so as to be slidable under the tension of the paper on a guide 15 provided along the guide rail 1. To the opposite ends of the slider 19 are secured the ends of a chain 18 passing around a pair of sprockets 17 provided in each end of a frame 16 which is provided over and along the guide rail. A motor 20 is coupled to the axis of the sprocket 17 through a power clutch (not shown).

The torque of the power clutch is set to be slightly larger than the maximum tension normally applied to the paper. When the motor 20 is energized, the slider 19 moves to the right in FIG. 1, i.e., toward the other end of the guide rail 1. When the slider 19 touches a limit switch 21 provided at the corresponding end of the guide rail 15, the motor 20 stops.

Figure 3:
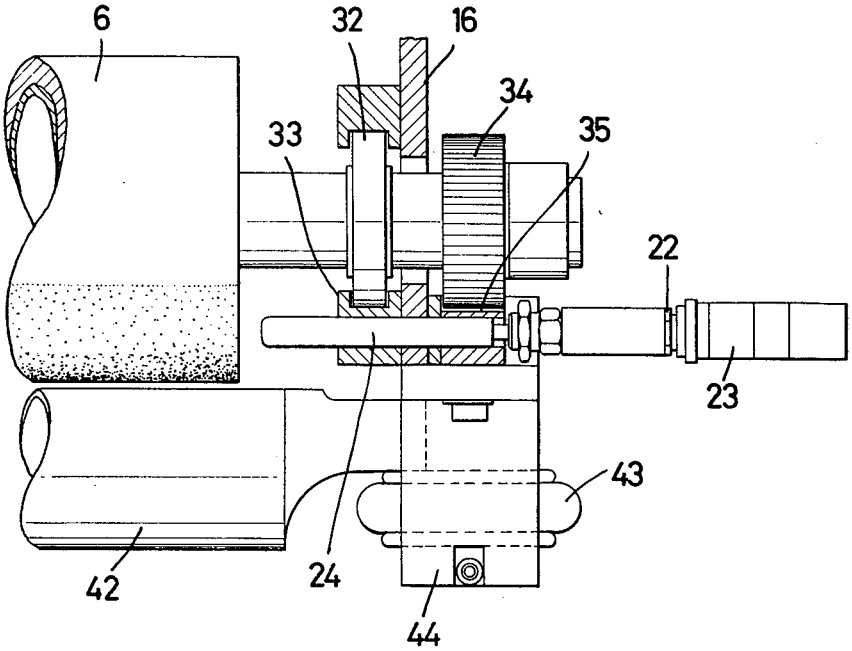
FIG. 3 is a vertical sectional view of the portion shown in FIG. 2.

A pair of stops 22 shown in FIG. 3 are provided for stopping the splicing rollers 6 and 7 from rotating during the preparation for splicing. Each stop comprises a piston rod 24 of a cylinder 23 supported on the carriage 3, said piston rod being adapted to be pressed against the end surface of the splicing roller to stop it.

Figure 5:
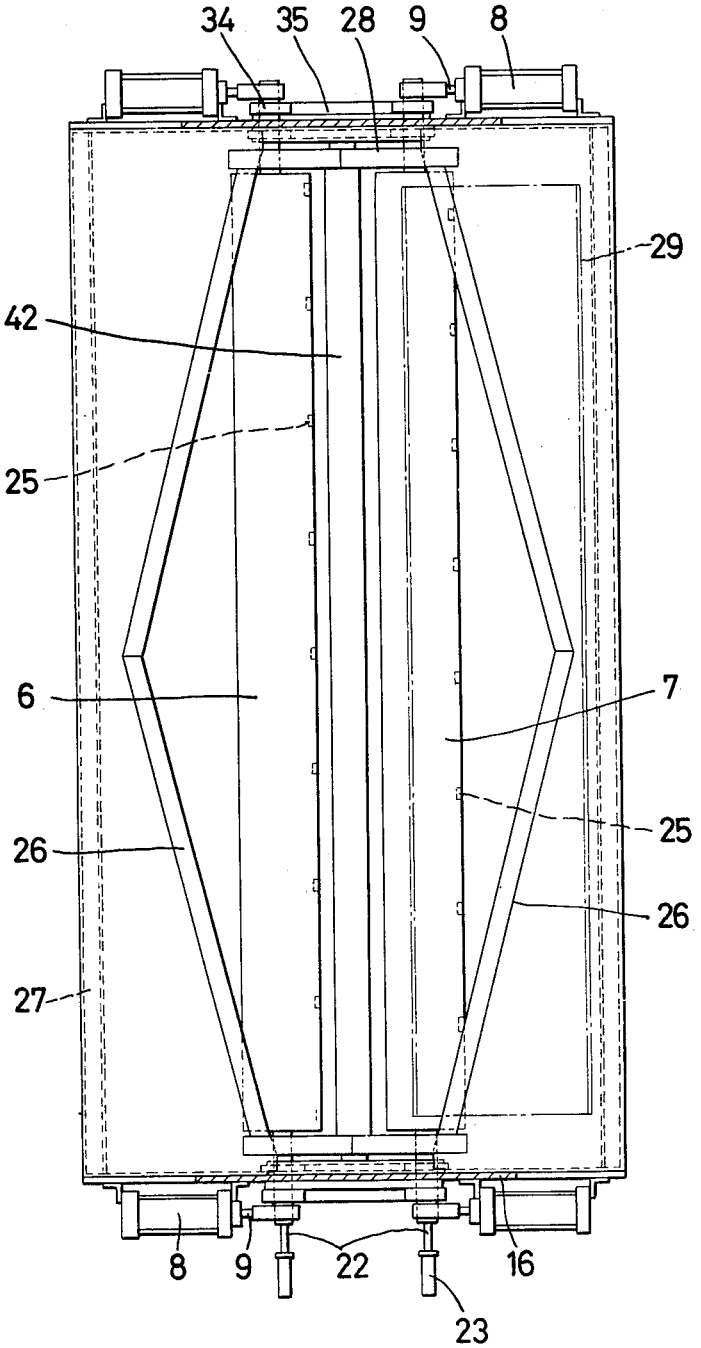
FIGS. 5 and 6 are plan views showing how the blades are arranged.
Figure 6:
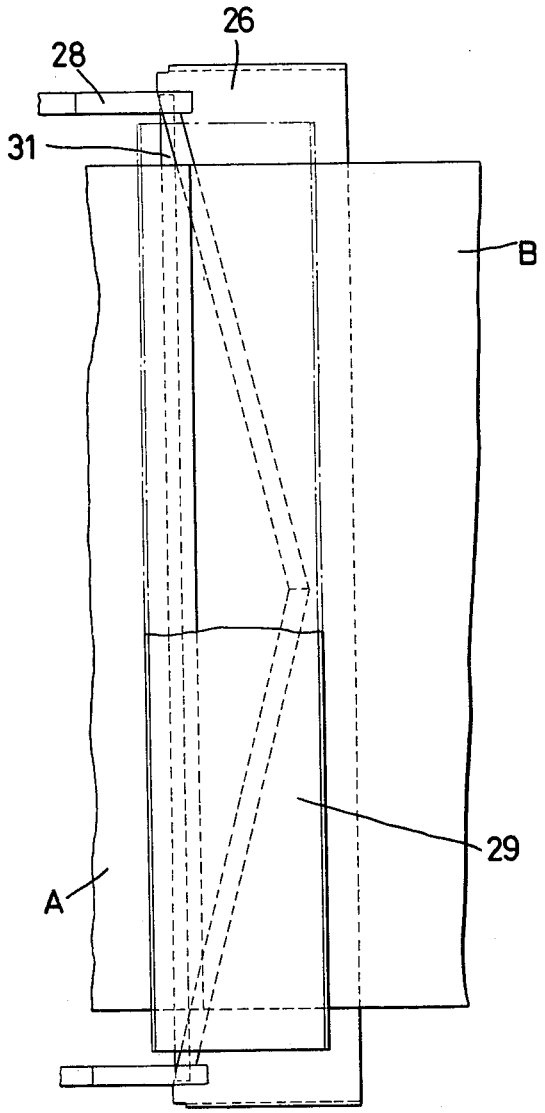
Figure 7:
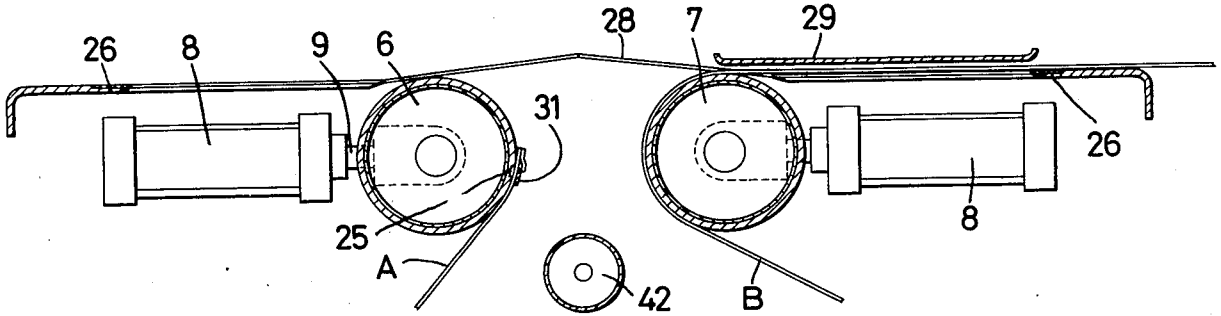
FIGS. 7 to 10 are schematic elevation views showing how the splicing and cutting of paper are performed.

A plurality of permanent magnets 25 are embedded in each splicing roller, suitably spaced and aligned along the peripheral surface thereof in the axial direction. The permanent magnets in one splicing roller are axially offset from those in the other splicing roller (FIG. 5).

An opposed pair of blades 26 are horizontally supported on a frame 27 on the carriage 3 above the respective splicing rollers. The blades 26 have a cutting edge disposed on the opposed inner edges. The edge has a V-shape when viewed in plan in the preferred embodiment, but may be in any other forms such as linear and at an angle or an arcuate shape.

At each side of the machine and between the blades 26 is provided a guide plate 28 which rises from each end toward the center. A plate member 29 is provided over each blade 26 to prevent a hereinafter described plate member 31 from rising under tension to the paper. A receiving box 30 is provided under each blade 26 to receive a used plate member 31. It can be opened to take out the blades for re-use.

The splicing rollers 6 and 7 are moved toward and away from each other by means of the cylinders 8. Each splicing roller is provided with a wheel 32 and a pinion 34 at each end thereof, said wheel rolling on a rail 33 and said pinion engaging a rack 35 for smooth movement of the splicing roller.

The numeral 36 designates a paper feed means for feeding the paper from a new roll for splicing. Said means comprises two feed devices, each having a belt conveyor 38 mounted so as to be pivotable toward the paper roll and a cylinder 40 having its piston rod 41 coupled to a projection 39 on the frame of the feed device adjacent a motor driven pulley shaft 37 of the conveyor. When the cylinder is actuated, the belt conveyor 38 is pivoted so that its leading side is pressed against the outer periphery of the paper roll.

A brake bar 42 is provided between and under the splicing rollers 6 and 7 to brake the paper feed when one splicing roller is pressed against the other for splicing with the paper nipped therebetween. It is pushed up against the splicing roller 6 (or 7) by a diaphragm 43 supported by a mounting 44 on the carriage 3.

The operation of the splicing machine according to the present invention will be described below.

Two rolls A′ and B′ of paper A and B are first set on a pair of roll holders (not shown). The leading end of paper B is pulled out of one paper roll with the carriage 3 located just over the other paper roll, and passed around the splicing roller 7, between the first and second guide rollers 10 and 11, around the third guide roller 12, the accumulator roller 13 and the fourth guide roller 14, to a corrugating machine 45 (FIG. 1).

Figure 11:
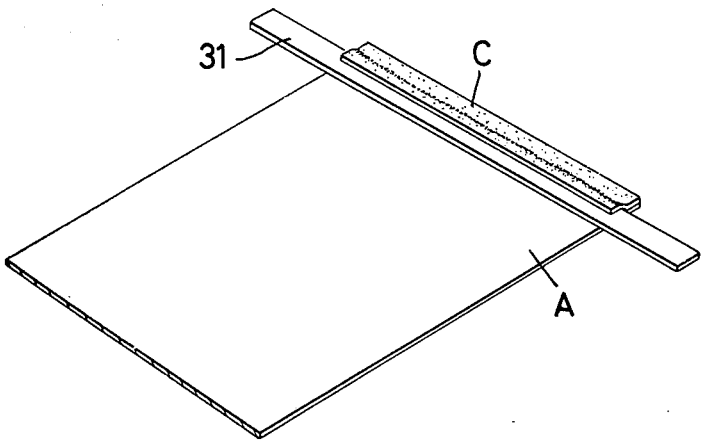
FIGS. 11 and 12 are perspective views showing the manner in which the plate member is mounted.

The leading end of paper A is then pulled out of the other paper roll. A narrow double-sided adhesive tape C is applied to the inner or splice side along the leading edge thereof and a plate-like metallic plate member 31 longer than the width of paper is placed laterally along but just inside of the leading edge of paper so as to be held by the rear portion of the adhesive tape C as illustrated in FIG. 11.

The end of the paper A with the movable blade is moved to the periphery of the splicing roller 6, which acts as support means therefor, to cause the blade member to be attracted by the permanent magnets 25. The paper end is now supported on the roller 6 with the adhesive tape C facing toward the other splice roller 7. The splicing roller 6 is blocked against rotation by the stop mechanism 22 to keep it in position. The stop mechanism for the other roller 7 is left disengaged to allow the other roller to rotate.

With the machine in this state, the paper from the roll B' is supplied continuously to the corrugating machine 45. When the paper roll B' is running short, the splicing roller 7 is moved toward the roller 6 to a standby position a slight distance from the latter by actuating the cylinder 8. The cylinder 40 is also actuated to pivot the belt conveyor 38 for the paper roll A' into contact with the periphery thereof to prepare for the splicing.

Figure 8:
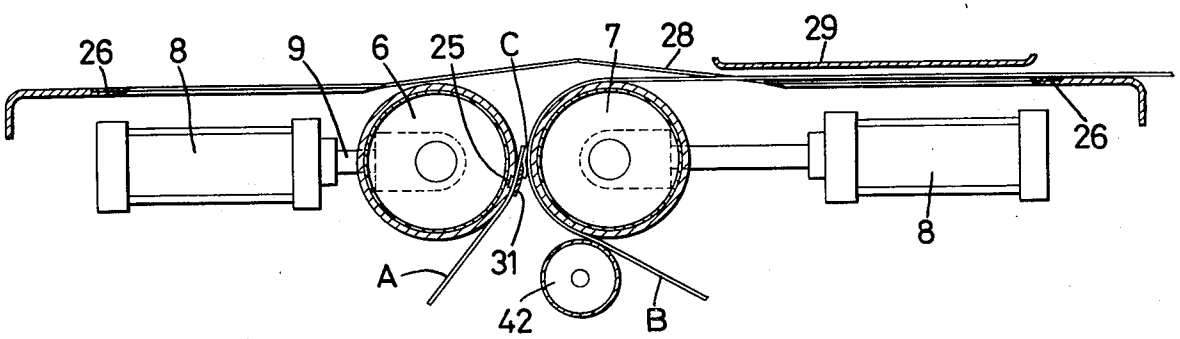

For splicing, the cylinder 8 is actuated to press the splicing roller 7 against the periphery of the splice roller 6 to splice new paper A to the paper B with the adhesive tape C interposed therebetween as in FIG. 8. The stop 22 for the roller 6 has been disengaged beforehand.

Thereupon the old paper B carries the new paper A spliced thereto. The arrangement of the circuit for controlling the various motors is such that simultaneously with the splicing, the belt conveyor 38 for the paper roll A' is started to feed the paper A at substantially the same speed as the speed at which the paper B is passing around the fourth guide roller 14.

Figure 4:
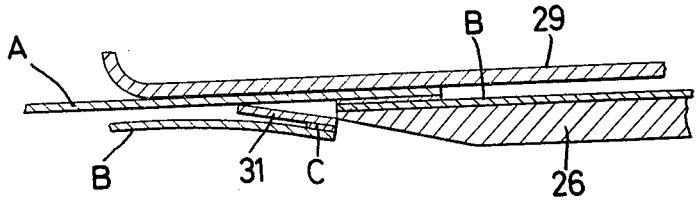
FIG. 4 is a vertical sectional view showing how the spliced paper is cut.
Figure 9:
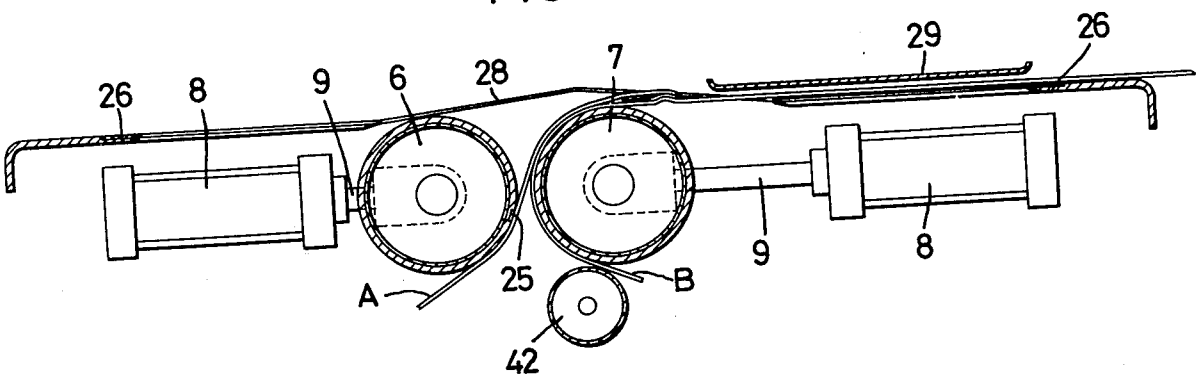
Figure 10:
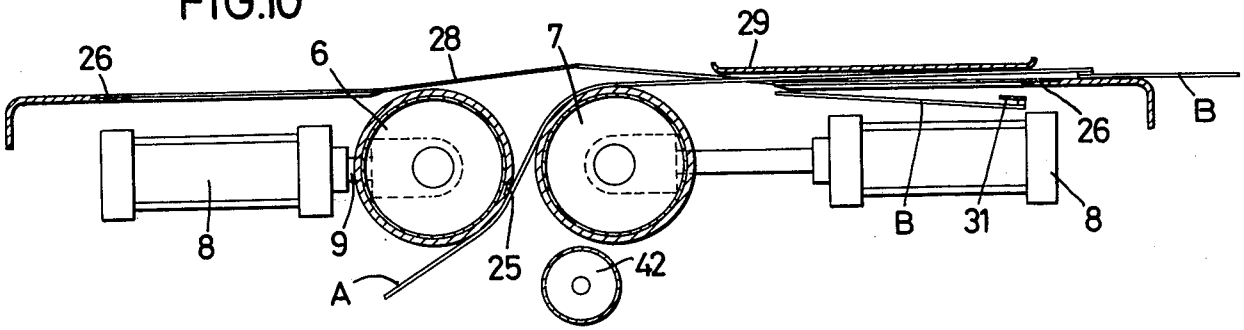

The plate member 31, which has been adhered to the opposing surface of the paper B by the adhesive tape C, runs toward the blade 26, sandwiched between the two papers at the point of the splice. As it runs, the guide plates 28 serve to keep the plate member 31 down (FIG. 9). As the spliced paper passes over the blade 26 the plate member 31 passes along the underside thereof, the plate member cooperates with the cutting edge of the plate 26 to cut the paper B and the adhesive tape C just behind the spliced area as will be best seen in FIG. 4.

Thereafter the new paper from the roll A' is continuously supplied. The cut-off portion of the paper B with the plate member 31 and part of adhesive tape C drops into the box 30.

During the splicing operation, the brake bar 42 is pressed up against the splicing roller 7 (FIG. 8) with the paper B interposed therebetween to reduce the feed speed only between the paper roll of paper being supplied and the fourth guide roller 14 to ensure a smooth splicing. However, the paper is fed at a normal machine speed from the fourth guide roller 14 on. To compensate for this deceleration, the accumulator roller 13 slides leftward (in FIG. 1) on the guide rails 15 under the increased tension of the paper. When the splicing roller 7 moves out of contact with the roller 6 and the brake bar 42 after splicing, the tension decreases so that the accumulator roller 13 is returned to its original position by the torque transmitted from the motor 20 through the power clutch. This arrangement ensures that there is no possibility of causing paper breakage or slackness.

Figure 13:
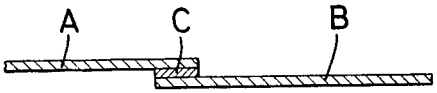
FIG. 13 is a vertical sectional view of the paper that has been spliced and cut.

In accordance with this invention, the old paper is cleanly cut with a minimum of overlap and the old paper B does not project rearwardly from the rear end of the adhesive tape C as seen in FIG. 13. Thus, it is possible to greatly reduce the producing of defective corrugated boards. Also, machine downtime can be minimized because splicing can be done without stopping the machine or decelerating the machine speed.

Figure 12:
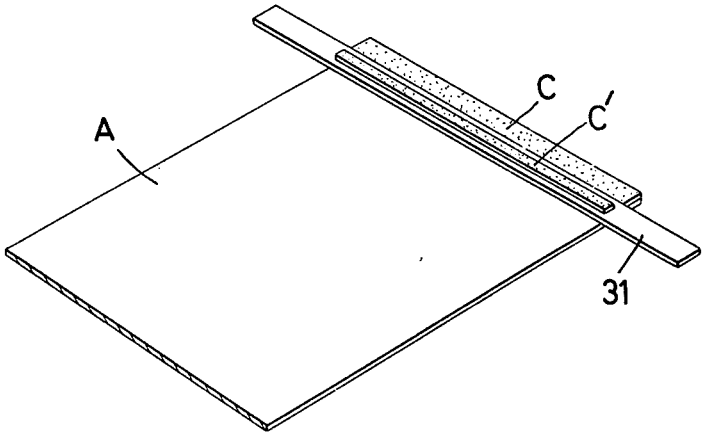

Although in the preferred embodiment the adhesive tape C is applied so as to cover the plate member 31 with its rear portion, a separate double-sided adhesive tape C' may be applied to said plate member as in FIG. 12 to adhere it to the opposing surface of the old paper being supplied.

Figure 14:
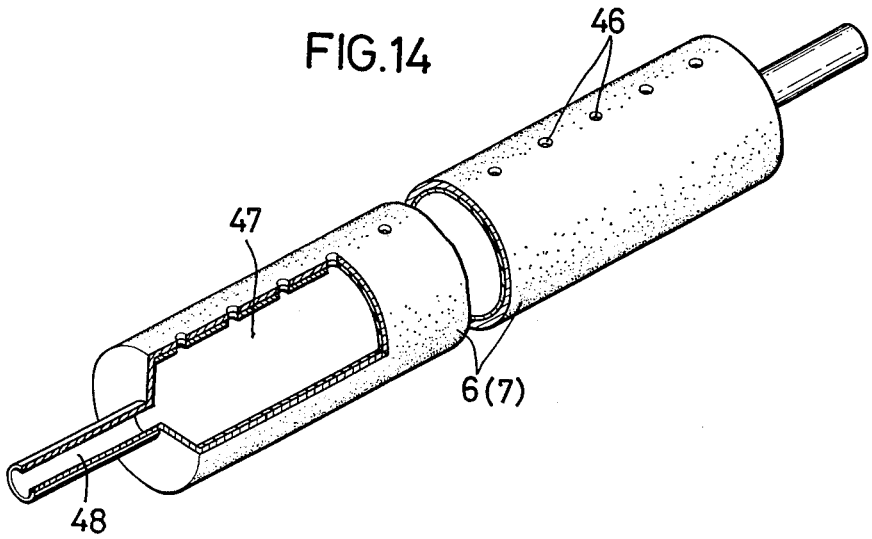
FIG. 14 is a perspective view of another example of the holding means.

Although in the preferred embodiment the plate member is held on the splicing roller by means of permanent magnets, it may be held in any other methods. For example, it may be held by suction force acting thereon through a plurality of suction ports 46 formed in the splicing roller in place of the permanent magnets and communicating through a center hole 47 in the splice roller and a passage 48 in the mounting shaft for the splicing roller with a source of vacuum, shown in FIG. 14.

Alternatively, the plate member may be lightly held with a clip provided at each end of the splicing roller, each splicing roller having an annular recess at each end thereof to accomodate the clip.

Further alternatively, separate double-sided adhesive tapes with different adhesive forces may be used to join not only the plate member and the old paper B but also the splice roller and the new paper A and the latter and the movable blade so that first the new paper A will come off the splice roller, and then the plate member will come off the new paper. Also, adhesive tapes may be replaced by magic tapes.

Or alternatively, the plate member may be held by means of any combination of two or more of the above-mentioned means.

Although in the preferred embodiment, as will be seen from the drawings, the carriage 3 is movable and the blade and the related parts are provided in pairs on both sides so that splicing can be carried out from a paper roll on either side of the paper feed means, the carriage can be stationary and the blade and related parts can be provided on one side only by using a roll holder on which two paper rolls are mounted and which is pivotable through 180 degrees.

Although there is shown an embodiment in which the old paper is cut off as the spliced paper runs in a horizontal plane, a vertical configuration may be adopted in which cutting is done as the spliced paper travels in a vertical plane.

While a preferred embodiment of the invention has been described, it is to be understood that other changes and variations may be made without departing from the scope of the following claims.

What is claimed is:

1. A process for splicing paper from a first roll of paper in a standby position to paper already being supplied from another roll of paper by an overlapping joint, said process comprising the steps of:

placing a plate member against the side of the paper from the first roll which is to be overlapped onto the opposing surfaces of the paper from the other roll and slightly spaced from and substantially parallel to the leading edge of the paper from the first roll;

applying adhesive means to said side of the paper from the first roll along the leading edge thereof with a portion thereof applied to said plate member for holding the plate member to the paper from the first roll;

holding the leading end of the paper from the first roll in position for splicing;

pressing the leading end of the paper from the first roll of paper against the opposed side of the paper from the other roll to splice the two papers in an overlapping joint by the adhesive means with said plate member held therebetween at a point just following the joint in the direction of travel of the papers; and passing the thus spliced papers over a blade having a cutting edge directed in a direction opposite to the direction of travel of the papers with the side of the paper from the other roll which is opposite from the side to which the paper from the first roll has been adhered being against one side surface of said blade, thereby cutting said paper from said other roll immediately behind the portion adhered to the paper of said first roll by means of said blade cooperating with said plate member when the plate member passes said blade along the other side thereof.

2. A process as claimed in claim 1 wherein said adhesive means is a single strip of double face adhesive material having one face adhered to the paper from said first roll and overlapping the surface of the plate member facing the paper from the other roll, whereby the single strip of adhesive material adheres the paper from the first roll to the paper from the other roll, adheres the plate member to the paper from the first roll prior to splicing, and adheres the plate member to the paper from the other roll immediately after the splicing.

3. A process as claimed in claim 1 wherein said adhesive means is a single strip of double face adhesive material having one face adhered to the paper from said first roll and to which the plate member is adhered on the face of the strip of adhesive material facing the paper from the other roll and a further strip of double face adhesive material on the face of said plate member facing the paper from the other roll.

4. A process as claimed in claim 1 wherein said plate member is positioned on said paper from said first roll in a direction substantially perpendicular to the direction of travel of the papers, and the cutting edge of said blade is at an angle to the direction of travel of the papers.

5. An apparatus for splicing a paper from a first roll of paper in a standby position to paper already being supplied from another roll of paper by an overlapping joint, said apparatus comprising:

paper guide means for guiding the paper from said other roll of paper in a path through said splicing apparatus;

support means adjacent and spaced from the path of the paper from the other roll for supporting the leading edge of paper from the first roll in the standby position and movable toward said path for moving the leading edge of the paper from the first roll to a position where it is pressed against the paper from the other roll;

a plate member for placing against the side of the paper from the first roll where it is supported on said support means and slightly spaced from and substantially parallel to the leading edge of the paper from the first roll;

means in said support means for holding said plate member in position against the paper supported by the support means;

adhesive means for application to the side of the paper from the first roll along the leading edge thereof with a portion thereof applied to said plate member for holding the plate member to the paper from the first roll; and a blade positioned along the path of the papers through the splicing apparatus and on the opposite side of the path from the side on which said support means is positioned and sufficiently close to the path for the paper from the other roll to contact the side surface of the blade, said blade having a cutting edge facing in a direction opposite to the direction of travel of the papers for cooperating with said plate member as said plate member moves past said blade for cutting the paper from said other roll immediately behind the portion adhered to the paper of said first roll.

6. An apparatus as claimed in claim 5 in which said adhesive means is a single strip of double face adhesive material, one face being for adherence to the paper from said first roll and overlapping and adhering to the surface of said plate member facing the paper from the other roll, whereby the single strip of adhesive material adheres the paper from the first roll to the paper from the other roll, adheres the plate member to the paper from the first roll prior to splicing, and adheres the plate member to the paper from the other roll immediately after the splicing.

7. An apparatus as claimed in claim 5 wherein said adhesive means is a single strip of double face adhesive material having one face for adherance to the paper from said first roll and to which the plate member is adhered on the face of the strip of adhesive material facing the paper from the other roll, and a further strip of double face adhesive material on the face of said plate member facing the paper from the other roll.

8. An apparatus as claimed in claim 5 further comprising a plate guide means along the path of the papers between said support means and said blade for guiding the plate member for causing it to pass on the side of the blade facing away from the path of the papers.

* * * * *